United States Patent [19]

Wittchow et al.

[11] Patent Number: 4,987,862

[45] Date of Patent: Jan. 29, 1991

[54] ONCE-THROUGH STEAM GENERATOR

[75] Inventors: Eberhard Wittchow, Erlangen; Wolfgang Koehler, Kalchreuth, both of Fed. Rep. of Germany

[73] Assignee: Siemens Aktiengesellschaft, Munich, Fed. Rep. of Germany

[21] Appl. No.: 373,081

[22] Filed: Jun. 28, 1989

[30] Foreign Application Priority Data

Jul. 4, 1988 [DE] Fed. Rep. of Germany ..... 3822606

[51] Int. Cl.[5] ..... F22B 37/00

[52] U.S. Cl. ..... 122/6 A; 122/235.12; 122/235.23; 122/406.4; 122/DIG. 4

[58] Field of Search ..... 122/7 R, 6 A, 155 R, 122/155 A, 235 K, 235 R, 235 A, 235 B, 406 S, DIG. 4

[56] References Cited

U.S. PATENT DOCUMENTS

| | | | |
|---|---|---|---|
| 3,172,396 | 3/1965 | Kane | 122/406 S |
| 3,202,138 | 8/1965 | Schroedter | 122/406 S |
| 4,123,994 | 11/1978 | Gersch et al. | 122/6 A |
| 4,344,388 | 8/1982 | Stevens | 122/6 A |
| 4,418,652 | 12/1983 | Rees | 122/235 K |
| 4,665,865 | 5/1987 | Zubrod | 122/6 A |

*Primary Examiner*—Edward G. Favors
*Assistant Examiner*—Denise L. F. Gromada
*Attorney, Agent, or Firm*—Herbert L. Lerner; Laurence A. Greenberg

[57] ABSTRACT

A once-through stem generator includes a vertical gas flue having a total given height, a bottom, a lower part having a height equal to less than 70% of the total given height, an upper part, and fossil fuel burners disposed on the lower part. The lower and upper parts are formed of gas-tight tube walls with tubes. The tubes of the lower part rise obliquely, while the tubes of the upper part are vertical. The lower part has a lower end limited by the bottom, and the upper part has an upper end limited a partition of the vertical gas flue, by a cross-sectional restriction of the tube walls, or by a lower edge of a heating surface within the vertical gas flue.

18 Claims, 2 Drawing Sheets

ONCE-THROUGH STEAM GENERATOR

The invention relates to a once-through steam generator having a vertical gas flue formed of gas-tight tube walls with tubes rising obliquely on a lower part of the gas flue and being disposed vertically on an upper part of the gas flue, and fossil fuel burners disposed on the lower part, the lower end of the the lower part being limited or defined by a bottom of the gas flue and the upper end of the upper part being limited or defined either by a partition or horizontal wall of the gas flue, by a cross-sectional restriction of the tube walls of the gas flue, or by a lower edge of heating surfaces disposed inside the gas flue.

Such a structure is already used in the typical type of steam generator. The transition from the tubes of the tube walls of the lower part of the gas flue to the tubes of the tube walls of the upper part can be made either directly, for instance by connecting three tubes of the upper part to one tube of the lower part, or indirectly through a header, to which the tubes of both the lower and upper parts are connected.

During operation of a once-through steam generator of this kind, the tubes of the lower part of the gas flue, in particular, which are greatly heated by the burners of the once-through steam generator, may exhibit quite considerable temperature differences at the locations where they exit to the tubes of the upper part or to the header, because of unavoidable differences in heating. Since the tubes of the tube walls are welded together in gas-tight fashion at the long sides thereof, these temperature differences lead to considerable thermal strains in the tube walls of the gas flue, which can cause tube bursts.

It is accordingly an object of the invention to provide a once-through steam generator, which overcomes the hereinafore-mentioned disadvantages of the heretofore-known devices of this general type and which avoids such tube bursts from excessive thermal strains.

With the foregoing and other objects in view there is provided, in accordance with the invention, a once-through steam generator, comprising a vertical gas flue having a total given height, a bottom, a lower part having a height equal to less than 70% of the total given height, an upper part, and fossil fuel burners disposed on the lower part, the lower and upper parts being formed of gas-tight tube walls with tubes, the tubes of the lower part rising obliquely, the tubes of the upper part being vertical, the lower part having a lower end limited by the bottom, and the upper part having an upper end limited a partition of the vertical gas flue, by a cross-sectional restriction of the tube walls, or by a lower edge of a heating surface within the vertical gas flue.

By limiting the height of the lower part of the gas flue of the once-through steam generator, the heat absorption by the tube walls in the lower part is also limited. The tubes of the lower part of the gas flue, at the locations of exit to the tubes of the upper part or to the intervening header, therefore predominantly carry wet steam. Increased heating of individual tubes of the lower part of the gas flue therefore only causes increased steam formation in these tubes, but not the formation of hot steam at high temperatures. Therefore only slight thermal strains, at most, can arise in the tube walls of the lower part of the gas flue.

Since the number of parallel-connected tubes on the flow side in the tube walls of the upper part of the gas flue as a rule is greater than in the tube walls of the lower part, the mass flow density in the tube walls of the upper part, which is a standard for the flow rate of the steam, and therefore the friction pressure loss in these two walls as well, are lower than in the tube walls of the lower part of the gas flue. The limitation in height of the lower part of the gas flue limits the friction pressure loss in the tubes belonging to the tube walls of the lower part of the gas flue as well. This means that a low overall friction pressure loss occurs in the tubes of the tube wall of the gas flue. The once-through steam generator only requires associated feedwater pumps of a small capacity, leading to good efficiency for a power plant in which the once-through steam generator is used.

If the tubes of the lower part of the gas flue are connected directly to the tubes of the upper part, then because of the height limitation of the lower part of the gas flue, the mass flow through the tubes of the tube walls of the gas flue is also equalized.

The tubes of the tube walls of the lower part of the gas flue which rise obliquely are only capable of absorbing small forces of gravity. In the case of such tube walls, vertical support strips of iron as a rule should therefore be provided on the outside, and the individual tubes of the tube walls of the lower part of the gas flue are firmly welded thereto. Due to the limited height of the lower part of the gas flue of the once-through steam generator, the length and cross section of these support strips, and therefore the number of weld points as well, can be limited. This in turn limits the manufacturing and assembly cost and therefore limits the expense for the once-through steam generator.

In accordance with another feature of the invention, the height of the lower part is equal to less than 65%, 60%, 55% or 50% of the total given height. In this way, thermal strains and therefore tube bursts in the tube walls of the gas flue are even better avoided.

In accordance with a concomitant feature of the invention, the tubes of the upper part have helically disposed internal ribs. This feature provides a low wall temperature of the tubes of the tube walls of the upper part of the gas flue of the once-through steam generator. These tube walls are therefore also adapted to the high heat induction to which they are exposed because of the limited height of the lower part of the gas flue.

Other features which are considered as characteristic for the invention are set forth in the appended claims.

Although the invention is illustrated and described herein as embodied in a once-through steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
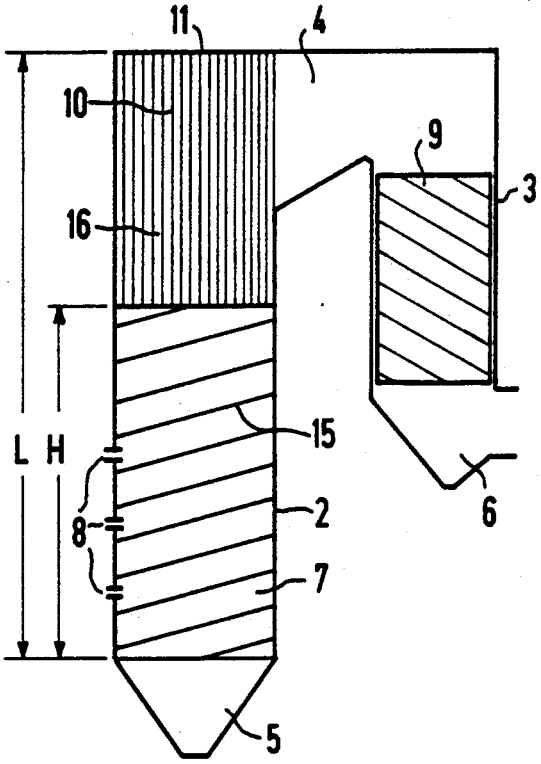
FIGS. 1–4 are highly diagrammatic, longitudinal-sectional views of once-through steam generators according to the invention.
Figure 2:
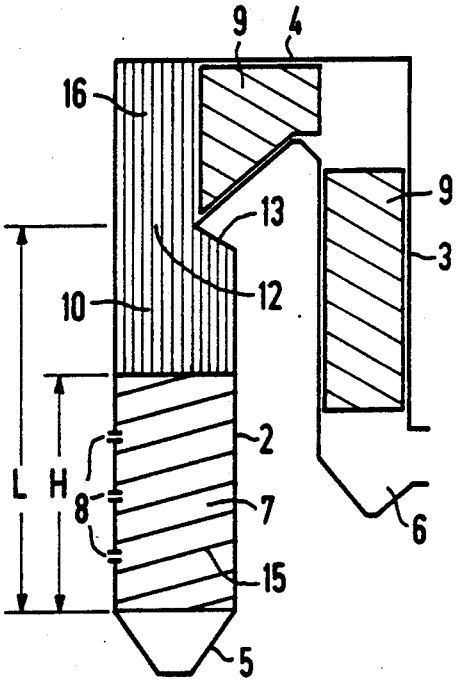
Figure 3:
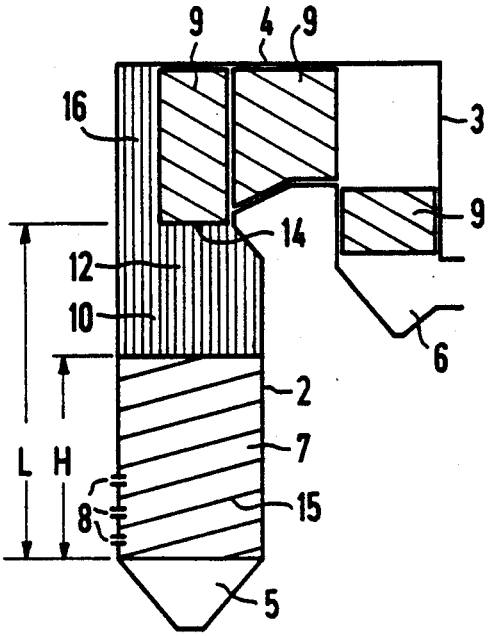
Figure 4:
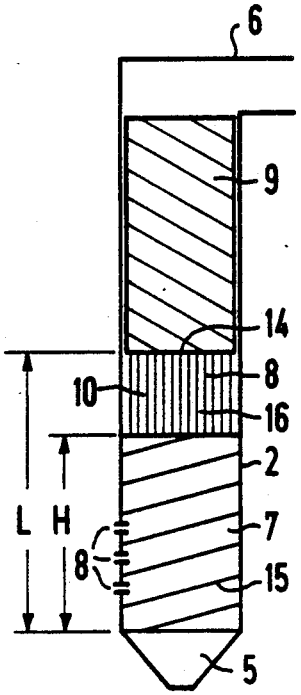

Referring now to the figures of the drawing in detail and first, particularly, to FIGS. 1–3 thereof, there are seen once-through steam generators which have two vertical gas flues 2 and 3 that are joined at the top by a horizontal gas flue 4. The once-through steam generator of FIG. 4 has only a single vertical gas flue 2.

The vertical gas flues 2 have a funnel-like bottom 5 at the lower end thereof, of the kind which is conventional for coal-fired steam generators. However, the bottom 5 may also be flat, as is typical for gas or oil-fired steam generators. The vertical gas flues 3 of FIGS. 1–3 have a flue gas outlet opening 6 on the bottom thereof. In the once-through steam generator of FIG. 4, this flue gas outlet opening 6 is at the top of the single vertical gas flue 2.

The vertical gas flue 2 has a lower part 7, with a lower end which is limited by the bottom 5, and a height H in the vertical direction.

Burners 8 for fossil fuel, such as coal, are mounted on the lower part 7. Heating surfaces 9 are also located inside the vertical gas flue 3 of the once-through steam generator of FIG. 1. In the once-through steam generator of FIG. 2, such heating surfaces 9 are disposed not only inside the vertical gas flue 3 but also inside the horizontal gas flue 4. The once-through steam generator of FIG. 3 has such heating surfaces 9 not only in the vertical gas flue 3 and in the horizontal gas flue 4 but also in the vertical gas flue 2 as well, while the once-through steam generator of FIG. 4 has such heating surfaces 9 only at the top, in the vertical gas flue 2.

The vertical gas flue 2 also has an upper part 10. The upper end of the upper part 10 in the once-through steam generator of FIG. 1 is limited or defined by an upper partition or horizontal wall 11 of the gas flue 2. In the once-through steam generator of FIG. 2, the upper end of the upper part 10 is limited or defined by a cross-sectional restriction 12 formed by a protrusion 13 projecting into the gas flue 2 on a side wall of the gas flue 2. In the once-through steam generator of FIGS. 3 and 4, the upper end of the upper part 10 is limited or defined by a lower edge 14 of the heating surfaces 9. In the lower part 7 having the height H, the vertical gas flue 2 is formed by gas-tight tube walls, having tubes 15 which rise obliquely. However, these tubes 15 may also be disposed in such a way that obliquely rising and horizontal tubes alternate with one another.

In contrast, in the upper part 10, the vertical gas flue 2 is formed by gas-tight tube walls with vertically disposed tubes 16. For instance, three vertical tubes 16 of the tube walls of the upper part 10 of the gas flue 2 may be connected to one obliquely rising tube 15 of the tube walls of the lower part 7 of the gas flue 2. The lower part 7 and the upper part 10 of the gas flue 2 have a total height L.

In order to avoid thermal strains, particularly in the tube walls of the lower part 7 of the gas flue 2, the height H of the lower part 7 is advantageously 70% of the total height L of the parts 7 and 10 of the gas flue 2. The height H may also advantageously be 65, 60, 55 or even only 50% of the total height L. The lower this percentage, the lesser thermal strains in the tube walls of the lower part 7 of the gas flue 2. The percentage of the height H of the lower part 7 of the gas flue 2 has a lower limit primarily due to the burner configuration, because in the vicinity of the burners, the tubes 7 are heated very greatly, and the oblique disposition of the tubes 15 enables particularly good cooling.

Figure 5:
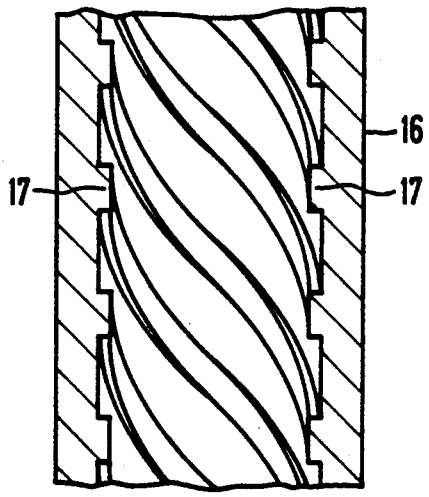
FIG. 5 is an enlarged, longitudinal-sectional view of one tube of the tube walls of the once-through steam generators of FIGS. 1–4.
Figure 6:
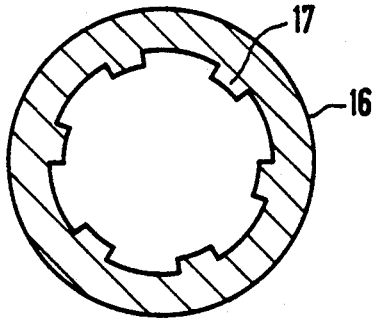
FIG. 6 is a cross-sectional view of the tube of FIG. 5.

As FIGS. 5 and 6 show, the tubes 16 of the tube walls of the upper part 10 of the gas flue 2 advantageously have helically disposed internal ribs 17. Wet steam flowing out of the tubes 15 of the tube walls of the lower part 7 of the gas flue 2 into the tubes 16 as shown in FIGS. 5 and 6 is subjected to centrifugal force in these tubes 16, so that its water component predominantly collects on the inside of the tubes 16. This water component reinforces the cooling of the tubes 16 at that location, so that the tubes 16 can readily absorb the major thermal induction from the interior of the gas flue 2 that they experience because of the low height H of the lower part 7 of the gas flue 2.

Figure 7:
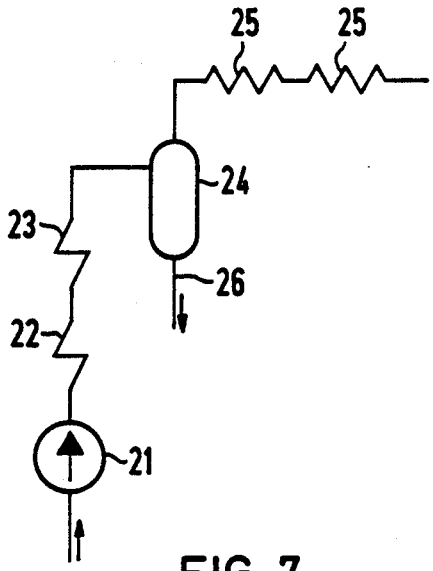
FIG. 7 is a highly schematic water/steam circuit diagram for the once-through steam generators of FIGS. 1–4.

In the water/steam circuit diagram of the once-through steam generator shown in FIG. 7, a feedwater preheater heating surface 22 is connected to a feedwater pump 21. Connected in series with the feedwater preheater heating surface 22 is an evaporator surface 23, which has a steam outlet line that is laterally connected to a normally vertically disposed water separation bottle 24. A steam outlet line leads from the upper end of the water separation bottle 24 to superheater heating surfaces 25. The lower end of the water separation bottle 24 is provided with a water drain line 26 that leads to a feedwater or expansion vessel or is provided with a circulating pump that discharges either between the feedwater preheater heating surface 22 and the evaporator surface 23, or between the feedwater pump 21 and the feedwater preheater heating surface.

The tube walls of both parts 7 and 10 of the gas flue 2 are part of the evaporator surface 23 in FIG. 7, while the heating surfaces 9 include both the feedwater preheater heating surface 22 and the superheater heating surfaces 25 in FIG. 7. In many operational situations, the evaporation region is not locally fixed, so that either superheating already takes place in the evaporator surfaces 23 of the tube walls of the gas flue 2, or evaporation also occurs in the superheater heating surface 25.

Water only flows through the water drain line 26 in FIG. 7 during the startup of the once-through steam generator and during operation at partial load. That is, in contrast to downpipes carrying water in a natural-circulation steam generator, the water drain line 26 is not connected to a horizontally disposed steam drum and it does not have water flowing through it all during operation, nor does it discharge directly into the evaporator surface without the interposition of containers or pumps.

We claim:

1. Once-through steam generator, comprising a vertical gas flue having a lower part with a lower end, an upper part with an upper end, a total given height between said lower end of said lower part and said upper end of said upper part, a bottom, and a transverse partition, said lower part having a height equal to less than 70% of said total given height, and fossil fuel burners disposed on said lower part, said lower and upper parts being formed of gas-tight tube walls with tubes, said tubes of said lower part rising obliquely, said tubes of said upper part being vertical, said lower part being limited at said lower end by said bottom, and said upper part being limited at said upper end by said transverse partition.

2. Once-through steam generator according to claim 1, wherein said height of said lower part is equal to less than 65% of said total given height.

3. Once-through steam generator according to claim 1, wherein said height of said lower part is equal to less than 60% of said total given height.

4. Once-through steam generator according to claim 1, wherein said height of said lower part is equal to less than 55% of said total given height.

5. Once-through steam generator according to claim 1, wherein said height of said lower part is equal to less than 50% of said total given height.

6. Once-through steam generator according to claim 1, wherein said tubes of said tube wall of said upper part have helically disposed internal ribs.

7. Once-through steam generator, comprising a vertical gas flue having a lower part with a lower end, an upper part with an upper end, a total given height between said lower end of said lower part and said lower end of said upper part, a bottom, and a cross-sectional restriction, said lower part having a height equal to less than 70% of said total given height, and fossil fuel burners disposed on said lower part, said lower and upper parts being formed of gas-tight tube walls forming said cross-sectional restriction and having tubes, said tubes of said lower part rising obliquely, and said tubes of said upper part being vertical, said lower part being limited at said lower end by said bottom, and said upper part being limited at said upper end by said cross-sectional restriction.

8. Once-through steam generator according to claim 7, wherein said height of said lower part is equal to less than 65% of said total given height.

9. Once-through steam generator according to claim 7, wherein said height of said lower part is equal to less than 60% of said total given height.

10. Once-through steam generator according to claim 7, wherein said height of said lower part is equal to less than 55% of said total given height.

11. Once-through steam generator according to claim 7, wherein said height of said lower part is equal to less than 50% of said total given height.

12. Once-through steam generator according to claim 7, wherein said tubes of said tube wall of said upper part have helically disposed internal ribs.

13. Once-through steam generator, comprising a vertical gas flue having a lower part with a lower end, an upper part with an upper end, a total given height between said lower end of said lower part and said lower end of said upper part, a bottom, and a heating surface with a lower edge being disposed within said vertical gas flue, said lower part having a height equal to less than 70% of said total given height, fossil fuel burners disposed on said lower part, said lower and upper parts being formed of gas-tight tube walls with tubes, said tubes of said lower part rising obliquely, and said tubes of said upper part being vertical, said lower part being limited at said lower end by said bottom, and said upper part being limited by said upper end by said lower edge of said heating surface.

14. Once-through steam generator according to claim 13, wherein said height of said lower part is equal to less than 65% of said total given height.

15. Once-through steam generator according to claim 13, wherein said height of said lower part is equal to less than 60% of said total given height.

16. Once-through steam generator according to claim 13, wherein said height of said lower part is equal to less than 55% of said total given height.

17. Once-through steam generator according to claim 13, wherein said height of said lower part is equal to less than 50% of said total given height.

18. Once-through steam generator according to claim 13, wherein said tubes of said tube wall of said upper part have helically disposed internal ribs.

* * * * *

UNITED STATES PATENT AND TRADEMARK OFFICE

CERTIFICATE OF CORRECTION

PATENT NO. : 4,987,862

DATED : January 21, 1991

INVENTOR(S) : Eberhard Wittchow et al

It is certified that error appears in the above-indentified patent and that said Letters Patent is hereby corrected as shown below:

Column 5,
Claim 7, line 4, "lower" (in the third instance)
should read - - upper - - ;

Column 6,
Claim 13, line 4, "lower" (in the third instance)
should read - - upper - - ;

Claim 13, line 14, "by" (in the first instance)
should read - - at - - .

Signed and Sealed this

Twenty-eighth Day of December, 1993

*Attest:*

Bruce Lehman

BRUCE LEHMAN

*Attesting Officer*

*Commissioner of Patents and Trademarks*